US006584647B2

(12) United States Patent
Jacquin

(10) Patent No.: US 6,584,647 B2
(45) Date of Patent: Jul. 1, 2003

(54) HINGE FOR A MOTOR VEHICLE REAR DOOR

(75) Inventor: Dominique Jacquin, Villebon sur Yvette (FR)

(73) Assignee: Oxford Automotive Mechanismes et Decoupage Fin, Les Ulis (FR)

( * ) Notice: Subject to any disclaimer, the term of this patent is extended or adjusted under 35 U.S.C. 154(b) by 0 days.

(21) Appl. No.: 09/742,349

(22) Filed: Dec. 22, 2000

(65) Prior Publication Data

US 2002/0050026 A1 May 2, 2002

(Under 37 CFR 1.47)

(30) Foreign Application Priority Data

Dec. 23, 1999 (FR) ..... 99 16417

(51) Int. Cl.[7] ..... E05D 11/06; E05D 11/10
(52) U.S. Cl. ..... 16/371; 296/146.12
(58) Field of Search ..... 16/386, 366, 368, 16/369, 371, 365, 334, 335, 332, 327; 403/83, 84, 96, 97; 296/146.11, 146.12

(56) References Cited

U.S. PATENT DOCUMENTS 2,494,682 A * 1/1950 Aspin ..... 16/371
2,621,359 A 12/1952 Schuyler
5,867,871 A * 2/1999 Tasman ..... 16/335

FOREIGN PATENT DOCUMENTS

| | | |
|---|---|---|
| DE | 26 08 778 | 9/1976 |
| DE | 93 05 933 | 8/1994 |
| FR | 2 323 853 | 4/1977 |
| GB | 1189954 | 4/1970 |

* cited by examiner

*Primary Examiner*—Anthony Knight
*Assistant Examiner*—Michael W White

(57) ABSTRACT

A hinge for a motor vehicle rear door (2) includes a fixed knuckle (20), a moving knuckle (30), an intermediate knuckle (40) connected to each of the knuckles by a hinge pin placed in a bushing secured to the corresponding knuckle and having a flat on its outer face and an immobilizing member (50) collaborating alternately with one of the flats of the bushings. The intermediate knuckle (40) is a plate having two parallel cheeks and the immobilizing member (50) is formed of a link rod (51) pressing against one of the cheeks of the intermediate knuckle (40) and located between the bushings.

3 Claims, 8 Drawing Sheets

HINGE FOR A MOTOR VEHICLE REAR DOOR

BACKGROUND OF THE INVENTION

The subject of the present invention is a hinge for a motor vehicle rear door.

Certain motor vehicles such as utility vehicles of the light van type for example, are equipped with rear doors that can be moved between a closed position and an open position lying against the side of the body of the vehicle so as to give full access to the loading platform and not project significantly beyond the width of this vehicle during the loading and unloading operations.

In order to allow the door to pivot between the two extreme positions, this door is equipped with a hinge which comprises a fixed knuckle mounted on the body of the vehicle, a moving knuckle mounted on the door, and an intermediate knuckle connected to each of the said knuckles by a hinge pin so as to allow the said door to pivot through approximately 250°.

The hinge comprises an immobilizing member collaborating with each of the hinge pins to lock them alternately in terms of rotation and, in succession, allow the moving knuckle to pivot about its hinge pin to an angle of between 0 and 180°, then allow the assembly consisting of the intermediate knuckle and the moving knuckle to pivot about the hinge pin of the fixed knuckle to an angle of between about 180 and 250°.

In the hinges used until now, the immobilizing member is formed of a part held on the intermediate knuckle by means of two screw-fastening elements each of which passes through this part via an oblong hole.

When the door is opened, the immobilizing member slides and successively immobilizes the two hinge pins by coming into contact with a flat formed on each of these hinge pins so as, first, to allow the moving knuckle to pivot by itself and, second, to allow the assembly formed by the moving knuckle and the intermediate knuckle to pivot.

As the door is closed, the immobilizing member first of all immobilizes the hinge pin of the moving knuckle so as to allow the assembly formed of the moving knuckle and the intermediate knuckle to pivot about the hinge pin of the fixed knuckle and then immobilizes the hinge pin of the fixed knuckle so as to allow only the moving knuckle to pivot about its hinge pin.

This type of assembly of the immobilizing member on the intermediate knuckle has the drawback of entailing the drilling of a hole in the intermediate knuckle and the machining of the oblong hole in this immobilizing member, and operations of assembling these various parts.

The object of the invention is to avoid these drawbacks.

SUMMARY OF THE INVENTION

To this end, the subject of the invention is a hinge for a motor vehicle rear door, of the type comprising:

- a fixed knuckle mounted on the body of the vehicle,
- a moving knuckle mounted on the rear door, which door can be moved between a closed position and an open position lying against the side of the said body,
- an intermediate knuckle connected to each of the said knuckles by a hinge pin placed in a bushing secured to the corresponding knuckle and having a flat on its outer face,

- an immobilizing member collaborating with the said flats to alternately immobilize the two bushings in terms of rotation and successively allow the moving knuckle to pivot about its hinge pin, then allow the assembly consisting of the intermediate knuckle and the moving knuckle to pivot about the hinge pin of the fixed knuckle as the rear door is opened and, conversely, as this door is closed, characterized in that the intermediate knuckle is formed of a plate comprising two parallel cheeks perpendicular to the said plate, and the immobilizing member is formed of a link rod held in position by one of the cheeks of the intermediate knuckle and the said bushings, the said link rod being moveable in a sliding manner as the bushing of the hinge pin of the moving knuckle rotates between two positions in contact, alternately, with the flat of each bushing.

According to other features of the invention:

- the link rod comprises, at each of its ends, a fork for positioning on the corresponding bushing and of which the width between the inner faces of the two branches is approximately equal to the outside diameter of this bushing,
- the length of the link rod between the bottoms of the two forks is approximately equal to the distance separating a flat of one of the bushings from a cylindrical portion of the other of the said bushings,
- when the rear door is in the closed position, the flat of the bushing of the fixed knuckle is in contact with the bottom of the corresponding fork of the link rod and the flat of the bushing of the moving knuckle is on the outside of the corresponding fork of the said link rod and runs parallel to the flat of the bushing of the said fixed knuckle.

BRIEF DESCRIPTION OF THE DRAWINGS

The features and advantages of the invention will be become apparent in the course of the description which will follow, which is given by way of example and made with reference to the appended drawings, in which.

DESCRIPTION OF THE PREFERRED EMBODIMENTS

The hinge depicted in the figures and denoted in its entirety by the reference 10 is intended to be mounted between a body 1 of a motor vehicle and a rear door 2 that can be moved between a closed position and an open position in which this rear door 2 lies against the side of the said body 1.

Figure 1:
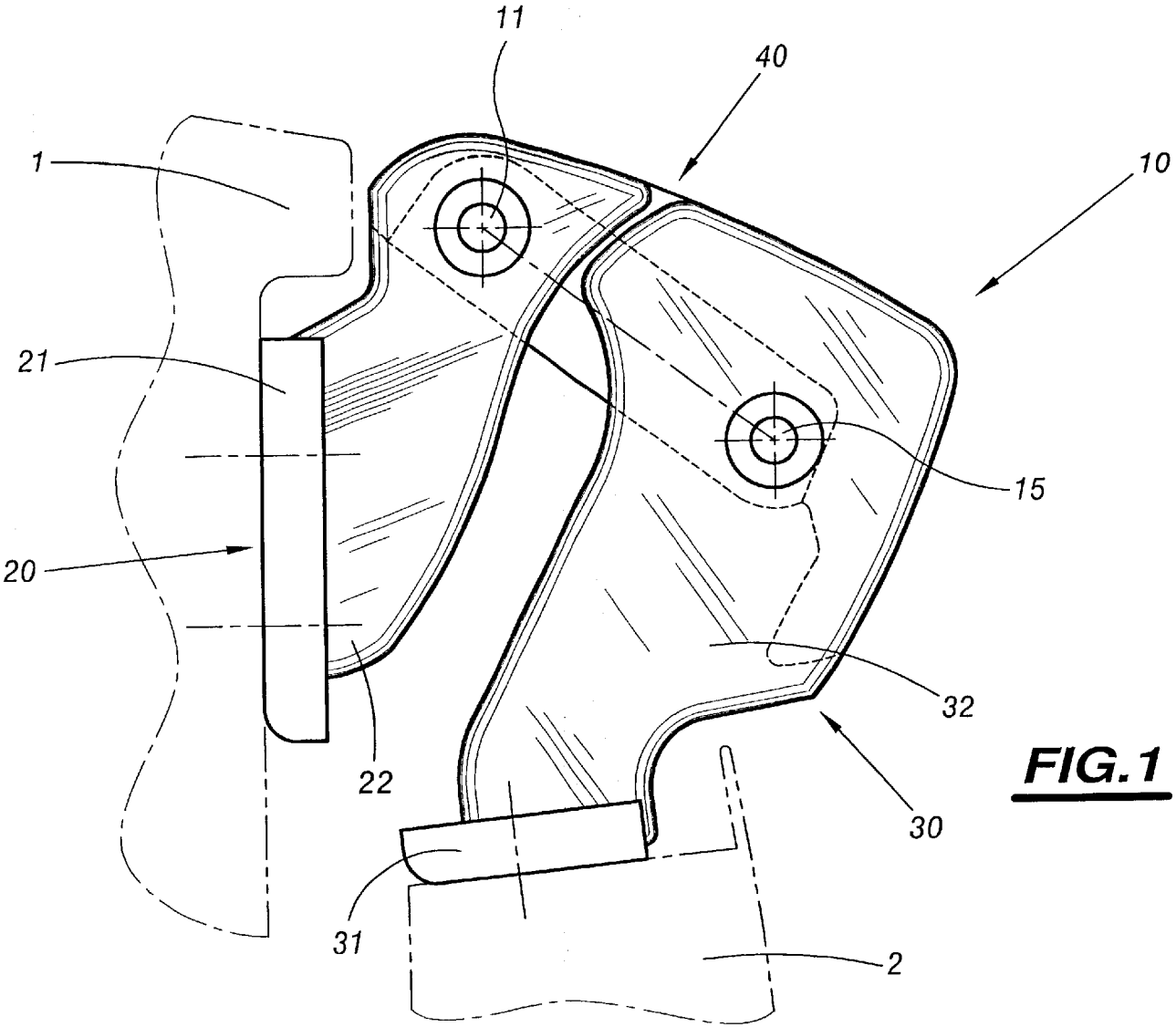
FIG. 1 is a schematic view from above of a hinge of a motor vehicle rear door according to the invention.
Figure 2:
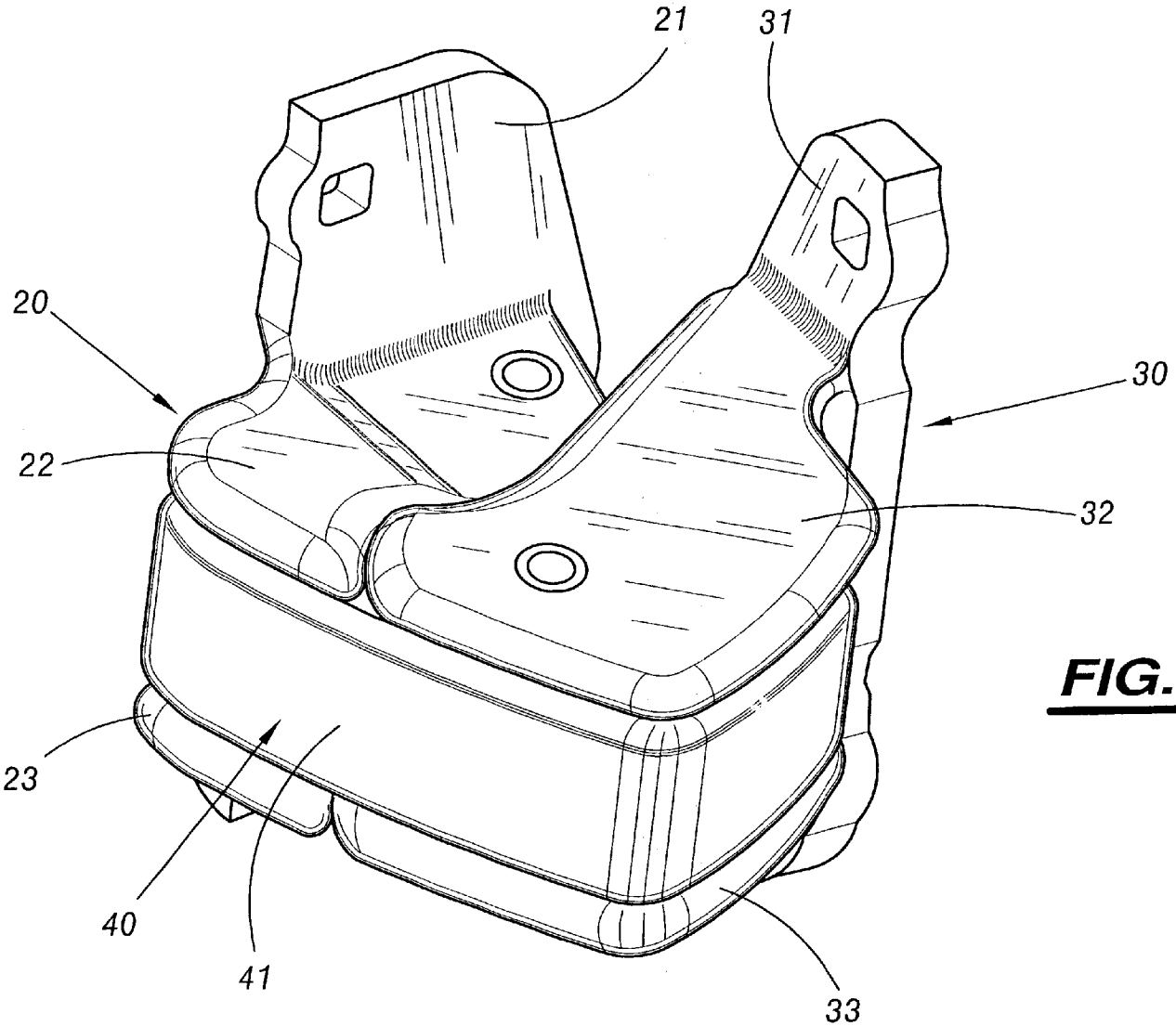
FIG. 2 is a schematic perspective view of the hinge when the door is in the closed position.
Figure 3:
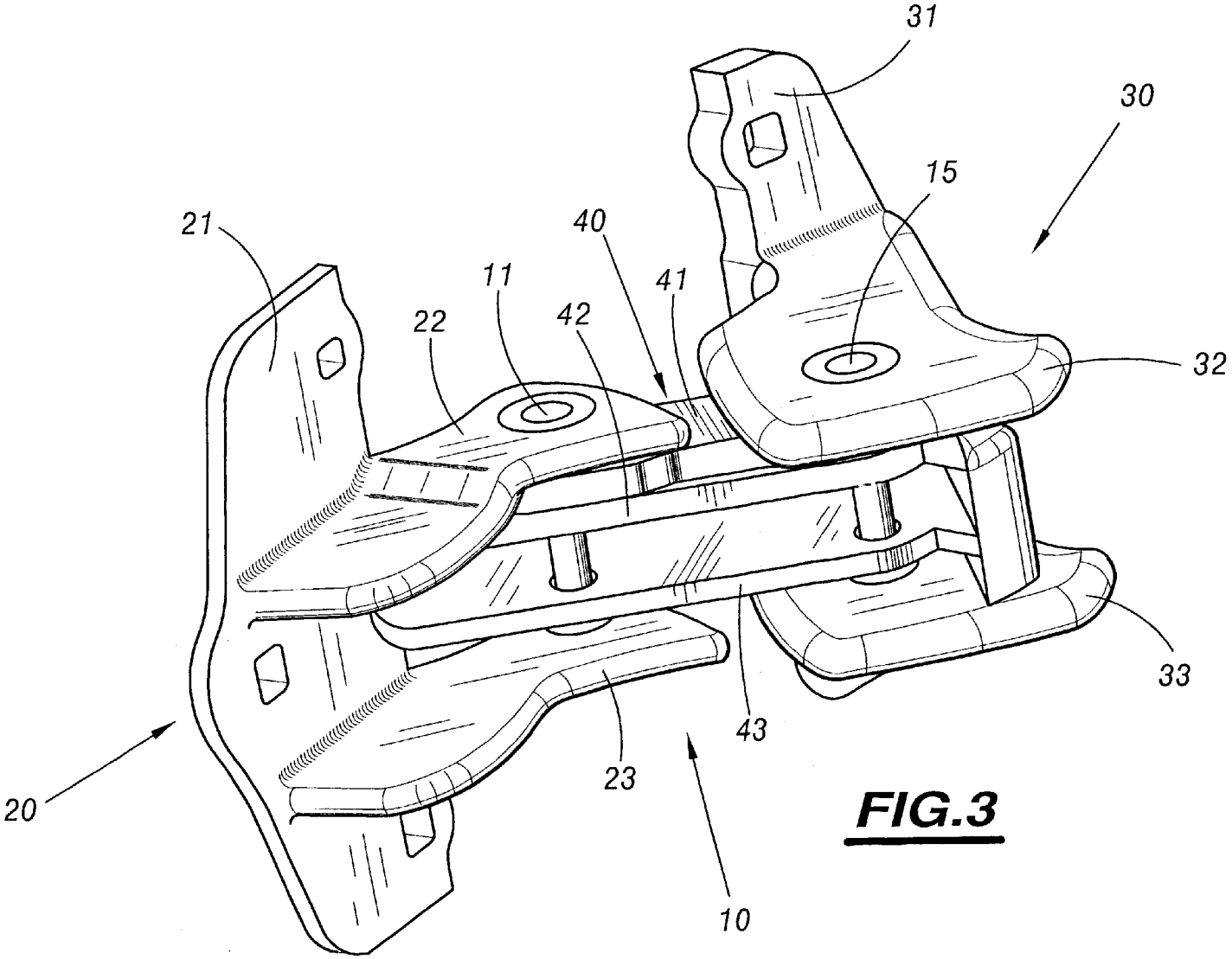
FIG. 3 is a schematic perspective view of the hinge when the door is in the open position.

As depicted in FIGS. 1 to 3, the hinge 10 comprises:

- a fixed knuckle 20 mounted on the body 1 of the vehicle,
- a moving knuckle 30 mounted on the rear door 2, and an intermediate knuckle 40 connected to each of the said knuckles 20 and 30.

The fixed knuckle 20 is in the form of a clevis block comprising, on the one hand, a plate 21 intended to be fixed to the body 1 of the vehicle by means, for example, of screw-fastening elements, not depicted, and, on the other hand, two parallel cheeks 22 and 23 respectively, running perpendicularly to the said plates 21.

Likewise, the moving knuckle 30 is in the form of a clevis block comprising, on the one hand, a plate 31 intended to be fixed to the rear door 2, for example using screw-fastening elements, not depicted, and, on the other hand, two parallel cheeks 32 and 33 respectively, running perpendicularly to the said plate 31.

As depicted in FIGS. 2 and 3, the intermediate knuckle 40 is mounted between the cheeks 22 and 23 of the fixed knuckle 21 and the cheeks 32 and 33 of the moving knuckle 31.

Figure 5:
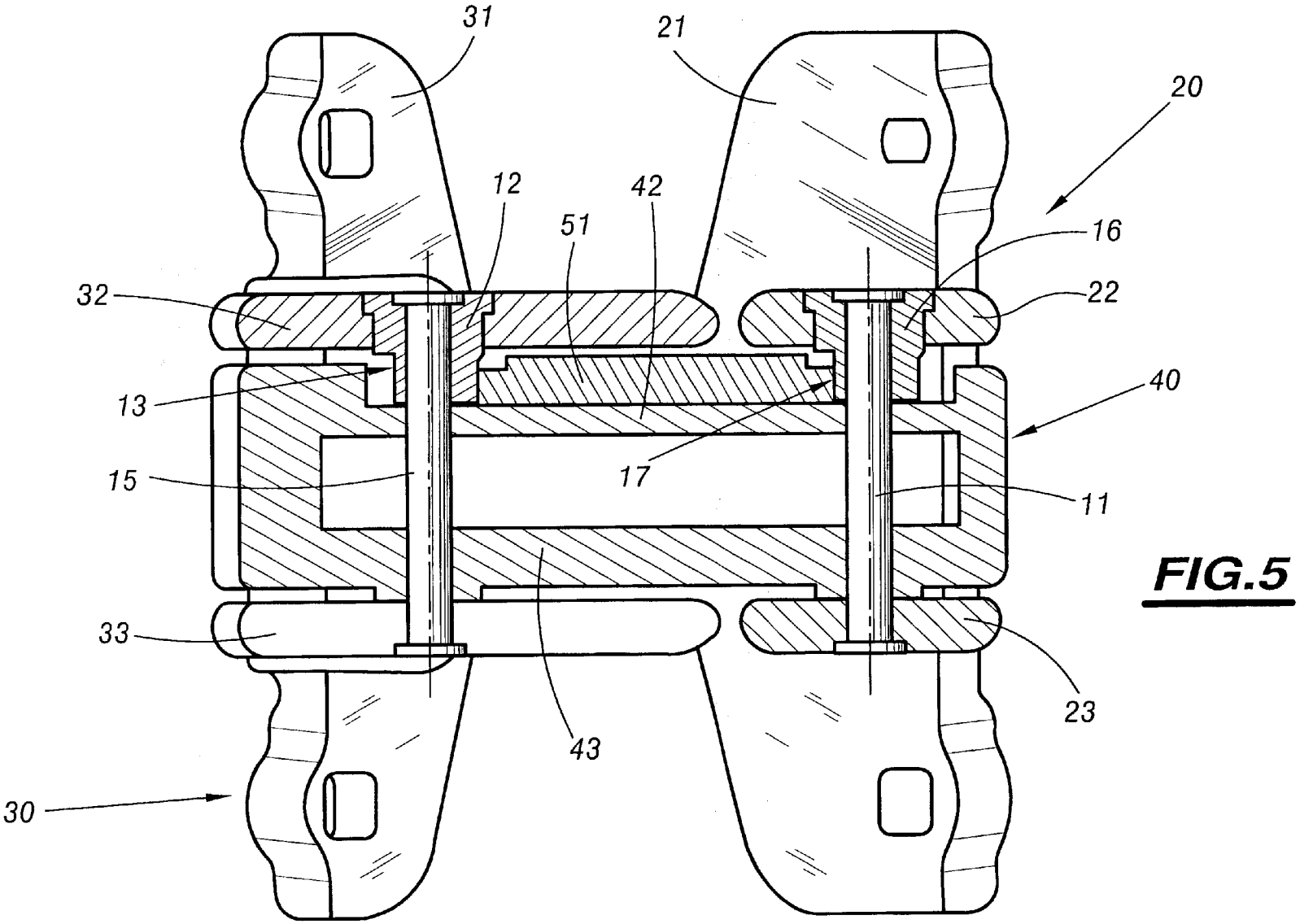
FIG. 5 is a view in section on 5—5 of FIG. 4, FIGS. 6, 7 and 8 are views in cross section of the hinge in positions in which the door is open at 90°, 180° and 250°, respectively.

This intermediate knuckle 40 comprises a plate 41 comprising two parallel cheeks 42 and 43 respectively, perpendicular to the said plate 41, as depicted in FIGS. 3 and 5.

The intermediate knuckle 40 is connected, on the one hand, to the fixed knuckle 20 by a hinge pin 11 which passes through the cheeks 22 and 23 of the fixed knuckle 20 and the cheeks 42 and 43 of the intermediate knuckle 40 and, on the other hand, to the moving knuckle 30 by a hinge pin 15 which passes through the cheeks 32 and 33 of the moving knuckle 30 and the cheeks 42 and 43 of the said intermediate knuckle 40.

Figure 4:
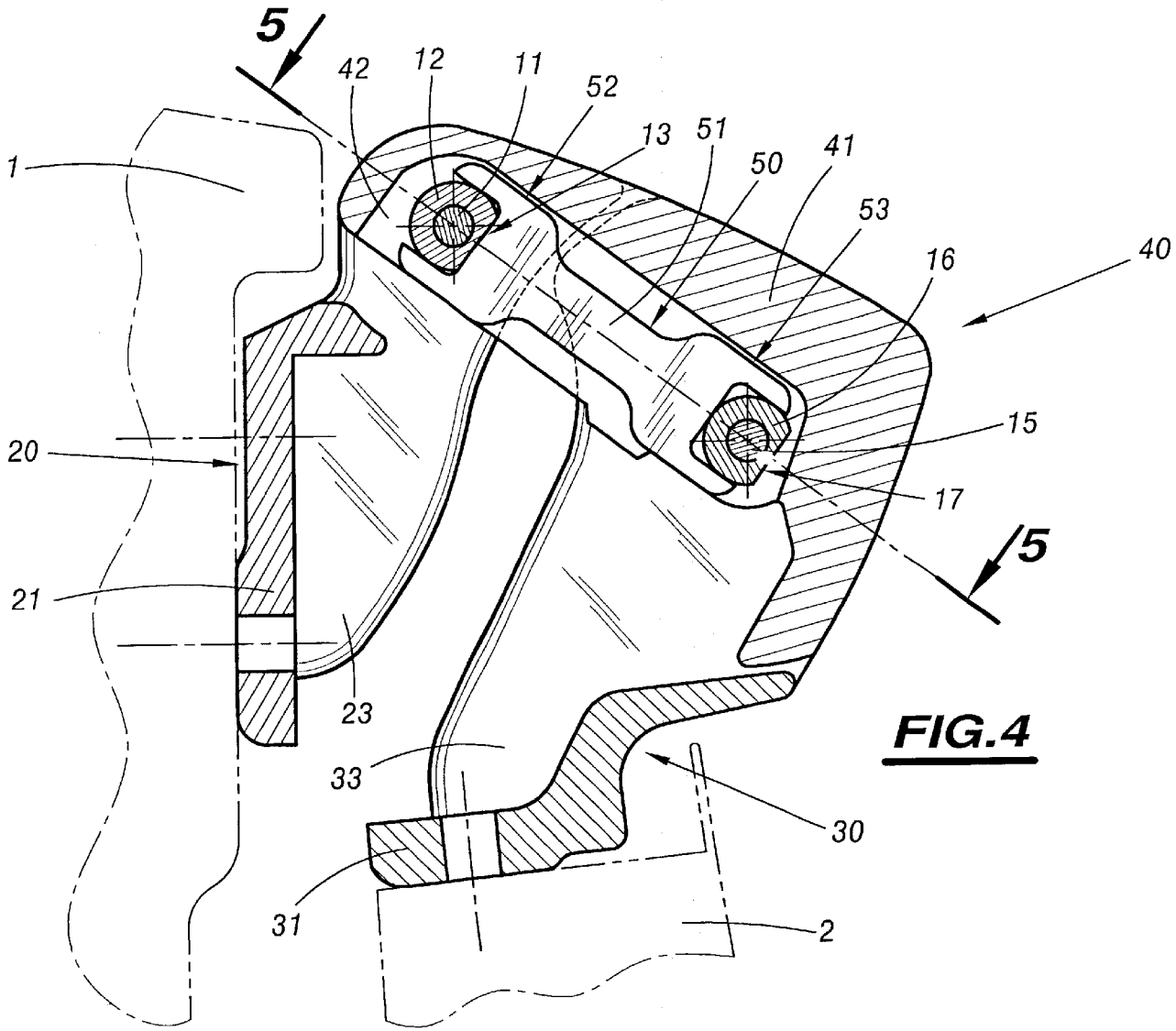
FIG. 4 is a view in cross section of the hinge when the door is in the closed position.

As depicted in FIG. 4, the hinge pin 11 located between the fixed knuckle 20 and the intermediate knuckle 40 is placed in a bushing 12 secured to the said fixed knuckle 20. This bushing 12 has a flat 13 on its outer face.

Likewise, the hinge pin 15 is placed in a bushing 16 which rotates as one with the moving knuckle 30. This bushing 16 comprises, on its outer face, a flat 17.

As depicted in FIGS. 3 and 4, the hinge 10 is also provided with an immobilizing member 50 collaborating alternately with one of the flats 13 and 17 of the said bushings 12 and 16 to successively allow the moving hinge 30 to pivot about the hinge pin 15, then allow the assembly consisting of the intermediate knuckle 40 and the moving knuckle 30 to pivot about the hinge pin 11 of the fixed knuckle 20 as the rear door 2 is being opened and, conversely, as this rear door is being closed, as will be seen later.

The immobilizing member 50 is formed by a link rod 51 which, as depicted in FIGS. 3 and 4, presses against the upper cheek 42 of the intermediate knuckle 40 and is located between the bushings 12 and 16.

The link rod 51 comprises, at its end facing the bushing 12 of the hinge pin 11, a fork 52 for positioning on the said bushing 12 and, at its end facing the bushing 16 of the hinge pin 15, a fork 53 for positioning on the said bushing 16.

Thus, the link rod 51 is held in position, on the one hand, by the upper cheek 42 of the intermediate knuckle 40 and the cheeks 22 and 32 respectively of the fixed knuckle 20 and of the moving knuckle 30 and, on the other hand, by the bushings 12 and 16 of the respective hinge pins 11 and 15.

In an alternative form, the link rod 51 may be placed under the lower cheek 43 of the intermediate knuckle 40. In this case, the link rod 51 is held by the cheek 23 of the fixed knuckle 20 and the cheek 33 of the moving knuckle 30.

As depicted in FIG. 4, the width between the inner faces of the two branches of each fork 52 and 53 is roughly equal to the outside diameter of the bushings 12 and 16 and the length of the link rod 51 between the bottoms of the two forks 52 and 53 is roughly equal to the distance separating a flat of one of the bushings from a cylindrical portion of the other of the said bushings.

When the rear door 2 is in the closed position as depicted in FIG. 4, the flat 13 of the bushing 12 of the fixed knuckle 20 is in contact with the bottom of the fork 52 of the link rod 51 and the flat 17 of the bushing 16 of the moving knuckle 30 is on the outside of the fork 53 of the said link rod 51 and lies parallel to the flat 13 of the bushing 12 of the said fixed knuckle 20.

In this position, the bushing 12 and the intermediate knuckle 20 are immobilized by the fork 52 of the link rod 51 which presses against the flat 13 of the said bushing 12.

By contrast, the bushing 16 and the moving knuckle 30 can be moved in terms of rotation given that the cylindrical portion of the bushing 16 is inside the fork 53 of the link rod 51.

Figure 6:
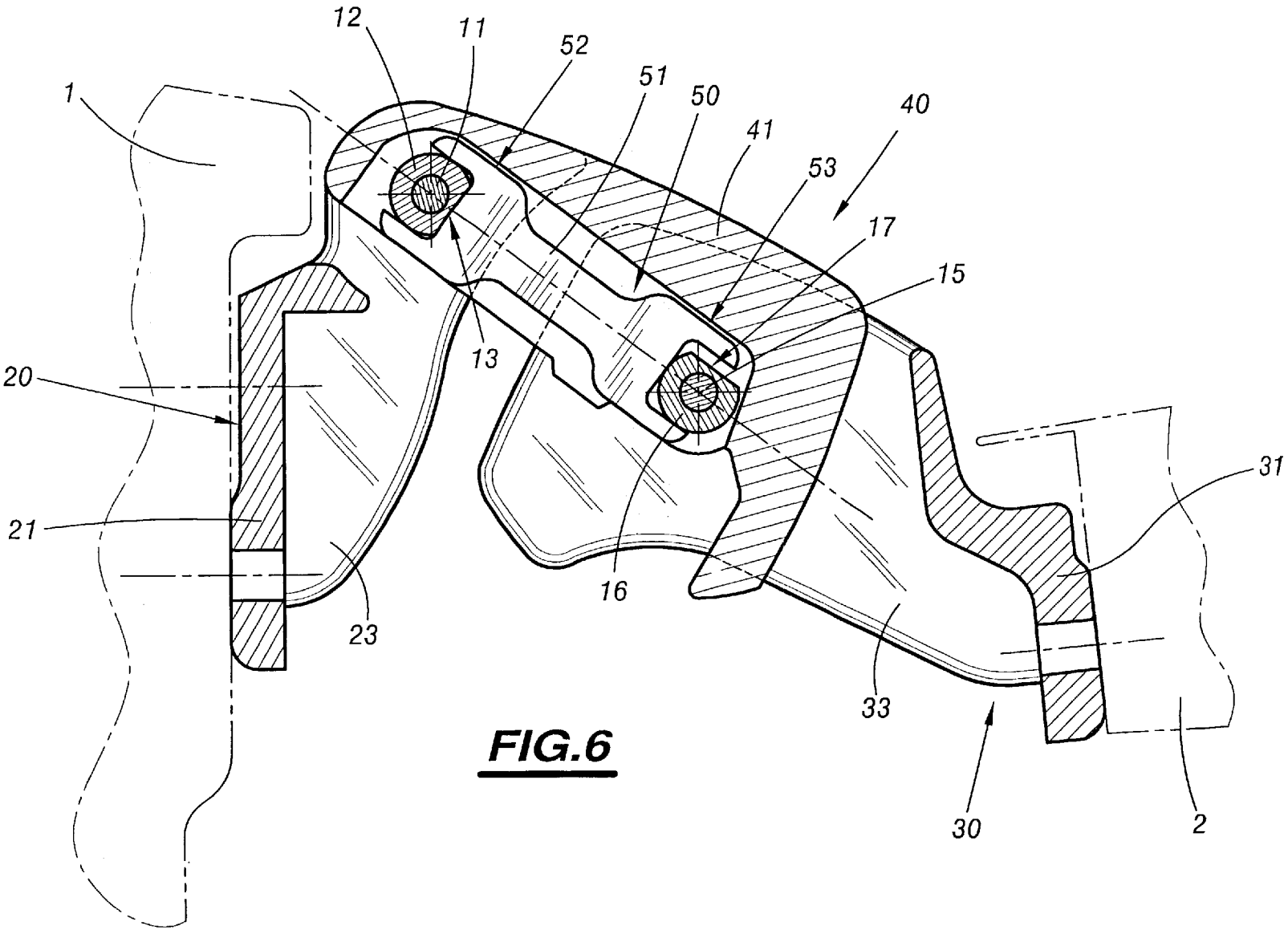

As the rear door 2 is being opened, the moving knuckle 30 pivots about the hinge pin 15, taking with it the bushing 16 which rotates inside the fork 53 of the link rod 51, as depicted in FIG. 6.

Figure 7:
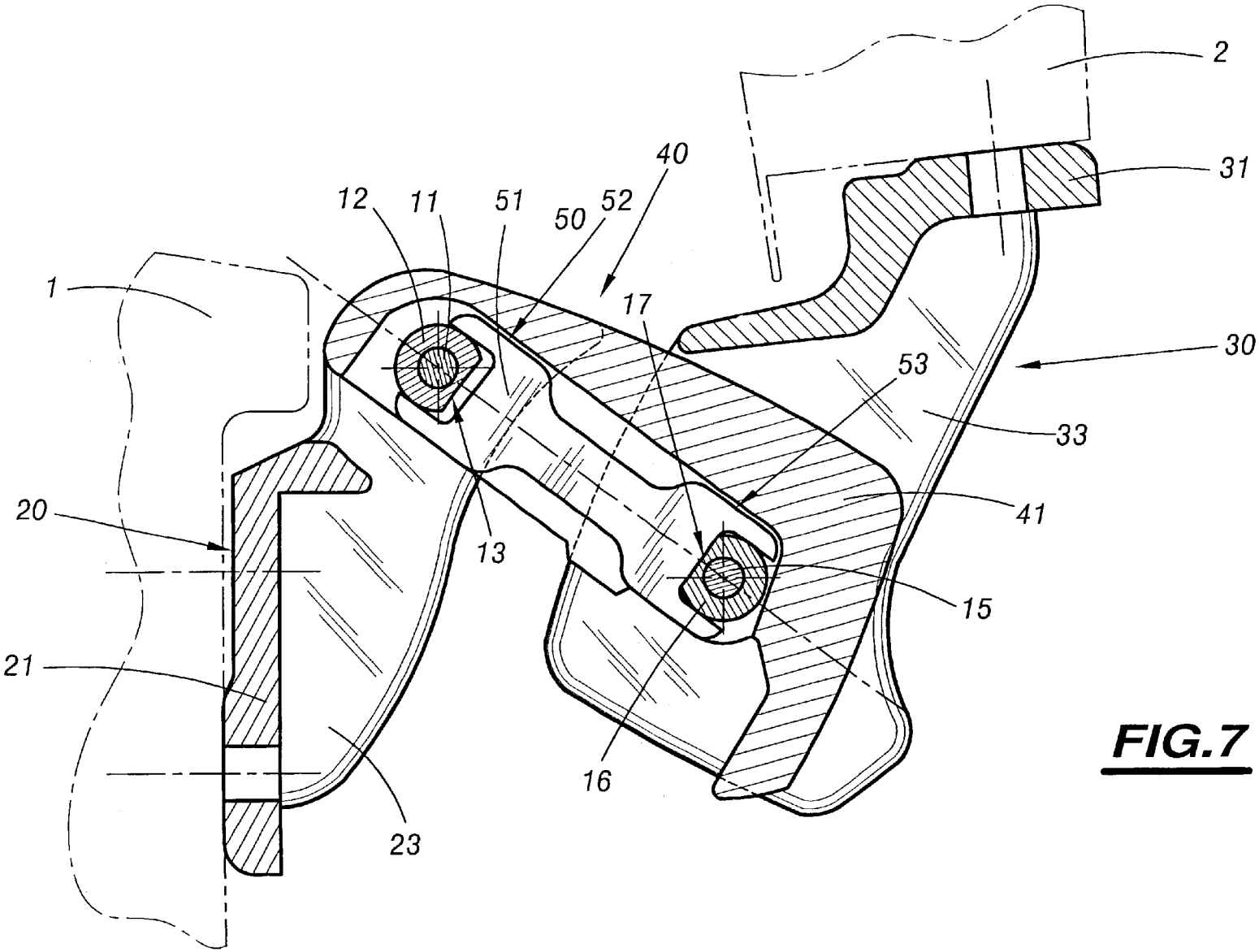

The rear door 2 and the moving knuckle 30 pivot between a first position in which this rear door 2 is closed and a second position in which this rear door is open by an angle of about 180°, as depicted in FIG. 7.

In this 180°-open position, the flat 17 of the bushing 16 secured to the moving knuckle 30 comes into contact with the bottom of the fork 53 of the link rod 51. The two flats 13 and 17 therefore face in opposite directions and the distance separating the two flats is greater than the distance separating the bottoms of the two forks 52 and 53 of this link rod 51 so that a clearance is thus created between these two flats 13 and 17 and the two bottoms of the forks 52 and 53 of this link rod 51.

Figure 8:
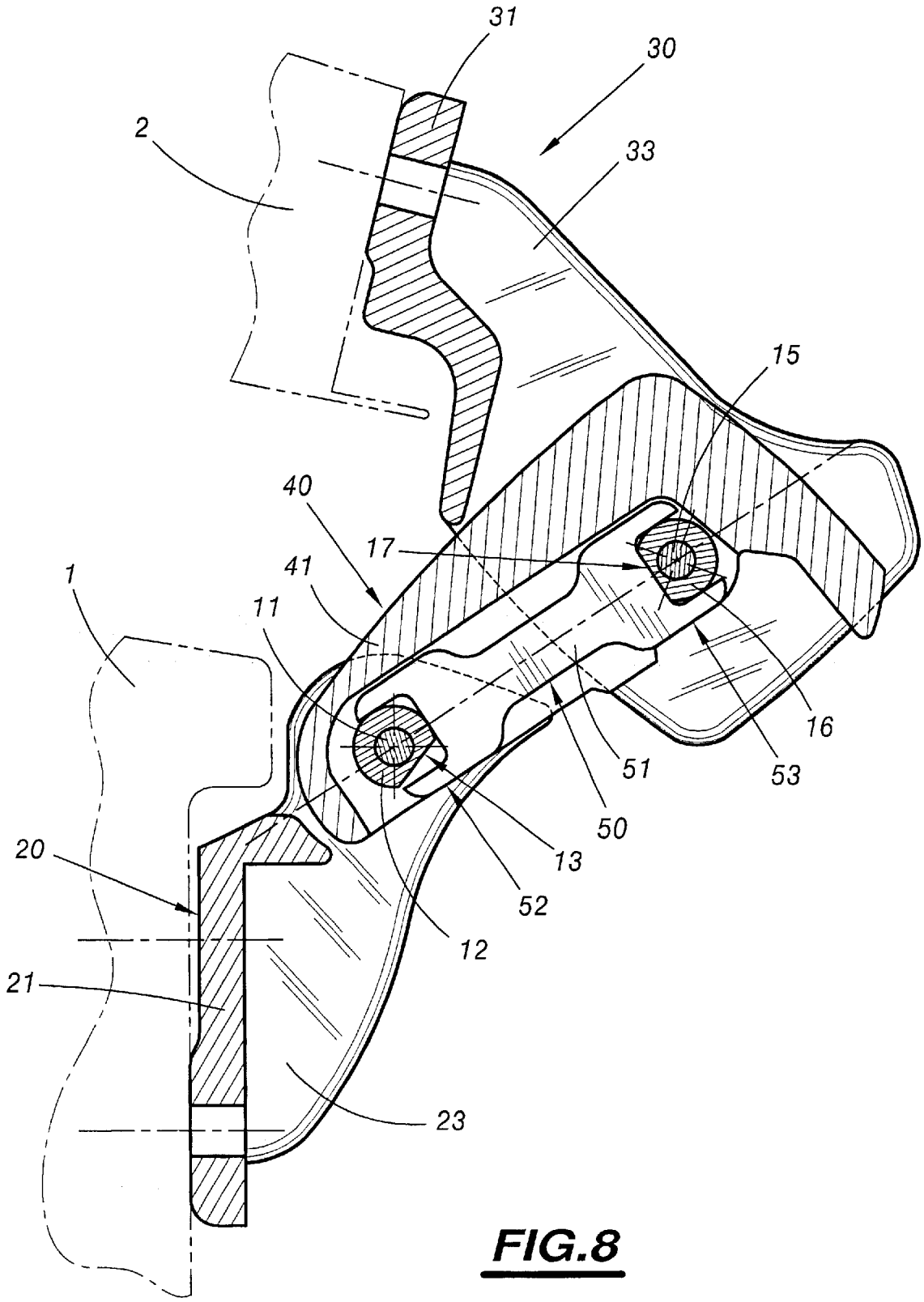

The moving knuckle 20 is now in abutment against the intermediate knuckle 40, so that as the rear door 2 pivots from this 180°-open position to the fully-open position against the side of the body of the motor vehicle as depicted in FIG. 8, the assembly consisting of the moving knuckle 30 and the fixed knuckle 40 pivots about the hinge pin 11 because of the clearance created between the flats 13 and 17 of the bushings 12 and 16 and the bottoms of the forks 52 and 53 of the link rod 51.

The reverse movements occur as the rear door 2 is being closed.

By virtue of this arrangement, the link rod is held on the cheek of the intermediate knuckle without any fastener and slides on this cheek as the rear door is being opened or closed, collaborating alternately with one of the flats formed on the bushings of the hinge pins of the moving knuckle and of the intermediate knuckle so as to allow this door to be opened into a fully-open position against the side wall of the body of the motor vehicle.

What is claimed is:

1. A hinge for a motor vehicle door, comprising:

a fixed knuckle (20) mounted on a body (1) of the vehicle;

a moving knuckle (30) mounted on a rear door (2) of the vehicle that is movable between a closed position and an open position lying against a side of said body (1);

an intermediate knuckle (40) connected to each of said fixed and moving knuckles (20; 30) by a respective hinge pin (11; 15) placed in a respective bushing (12; 16) secured to the respective one of said fixed and moving knuckles, each said bushing having a flat (13; 17) on an outer face thereof, an immobilizing member (50) collaborating alternately with one of said flats (13; 17) of said bushings (12; 16)

to successively allow said moving knuckle (30) to pivot about the respective said hinge pin (15), then allow said intermediate knuckle (40) and said moving knuckle (30) to pivot about the respective said hinge pin (11) of said fixed knuckle (20) as the rear door (2) is opened and, conversely, as the rear door is closed, wherein said intermediate knuckle (40) comprises a plate (41) and two parallel cheeks (42, 43) perpendicular to said plate (41), and said immobilizing member (50) comprises a link rod (51) held in position by one of said cheeks of said intermediate knuckle (40) and said bushings (12; 16), said link rod (51) being moveable in a sliding manner as the respective said bushing (16) of the respective said hinge pin (15) of said moving knuckle (30) rotates between two positions in contact with said flat (13; 17) of each said bushing (12; 16), and wherein said link rod (51) comprises, at each of its ends, a fork (52, 53) for positioning on the respective said bushing (12; 16) and wherein a width between inner faces of two branches of said fork is approximately equal to an outside diameter of said bushings (12; 16).

2. The hinge according to claim 1, wherein a length of said link rod (51) between bottoms of the two forks (52, 53) is approximately equal to a distance separating one said flat (13; 17) of one of said bushings (12; 16) from a cylindrical portion of the other of said bushings (12; 16).

3. The hinge according to claim 1, wherein when the rear door (12) is closed, said flat (13) of said bushing (12) of said fixed knuckle (20) is in contact with the bottom of the corresponding one of said forks (52) of the link rod (51) and said flat (17) of said bushing (16) of said moving knuckle (30) is on an outside of the corresponding fork (53) of said link rod (51) and runs parallel to said flat (13) of said bushing of said fixed knuckle (20).

* * * * *